US005788293A

United States Patent [19]

Krenzler

[11] Patent Number: 5,788,293

[45] Date of Patent: Aug. 4, 1998

[54] GOLD PAN WITH AGITATOR KNOBULES AND INSERT CUP

[76] Inventor: Leo M. Krenzler, 19950 Pacific Hwy. S., Suite 202, Seattle, Wash. 98188

[21] Appl. No.: 870,809

[22] Filed: Jun. 6, 1997

Related U.S. Application Data

[63] Continuation-in-part of Ser. No. 709,556, Sep. 6, 1996, abandoned.

[51] Int. Cl.[6] ..... B03B 5/04

[52] U.S. Cl. ..... 209/434; 209/444; 209/506

[58] Field of Search ..... 209/434, 444, 209/451, 452, 453, 506

[56] References Cited

U.S. PATENT DOCUMENTS

| | | | |
|---|---|---|---|
| 6,267 | 4/1849 | Jennison . | |
| 267,049 | 11/1882 | Wilson . | |
| 840,354 | 1/1907 | Lyle . | |
| 878,544 | 2/1908 | Leitch . | |
| 1,081,421 | 12/1913 | Arnold . | |
| 1,985,513 | 12/1934 | McCleery | 209/481 |
| 1,985,514 | 12/1934 | McCleery | 209/481 |
| 3,855,119 | 12/1974 | Stephenson | 209/447 |
| 4,008,152 | 2/1977 | Kleven | 209/444 |
| 4,267,036 | 5/1981 | Kleven | 209/444 |
| 4,389,308 | 6/1983 | Cleland | 209/444 |
| 4,406,783 | 9/1983 | Cleland | 209/444 |
| 4,476,014 | 10/1984 | Cleland | 209/434 |
| 4,517,079 | 5/1985 | Cleland | 209/452 |
| 4,522,711 | 6/1985 | Cleland | 209/298 |
| 4,561,973 | 12/1985 | Cleland | 209/434 |
| 4,642,180 | 2/1987 | Kaufman | 209/44 |
| 5,273,165 | 12/1993 | Krenzler | 209/434 |
| 5,275,294 | 1/1994 | Krenzler | 209/434 |
| 5,447,239 | 9/1995 | Tubbs | 209/434 |

*Primary Examiner*—David M. Bollinger
*Assistant Examiner*—J. Dillon
*Attorney, Agent, or Firm*—Kathleen T. Petrich; David P. Campbell; Glenn D. Bellamy

[57] ABSTRACT

A separator for separating gold particles from ore including a rotatable pan, and frame for mounting the pan through a recessed hub cup assembly at an angle from horizontal. The pan includes a frusto-conical side wall. The pan inner surface also includes a riffle spiraling inwardly from the outer end of the side wall to create loops that spiral to the hub cup. The riffle and the pan inner surface form a slide track in which the gold particles move along the riffle to reach the hub cup. One of the improvements includes a plurality of agitator knobules that are positioned between the loops of the riffle. Another feature is an easily removable insert cup inside the hub cup for easy collection of gold. In use, ore is introduced into the pan during rotation. Particles are agitated by the knobules to separate the particles from the ore and aid the particles down the slide track, moving the particles inwardly along the riffle into the insert cup.

18 Claims, 6 Drawing Sheets

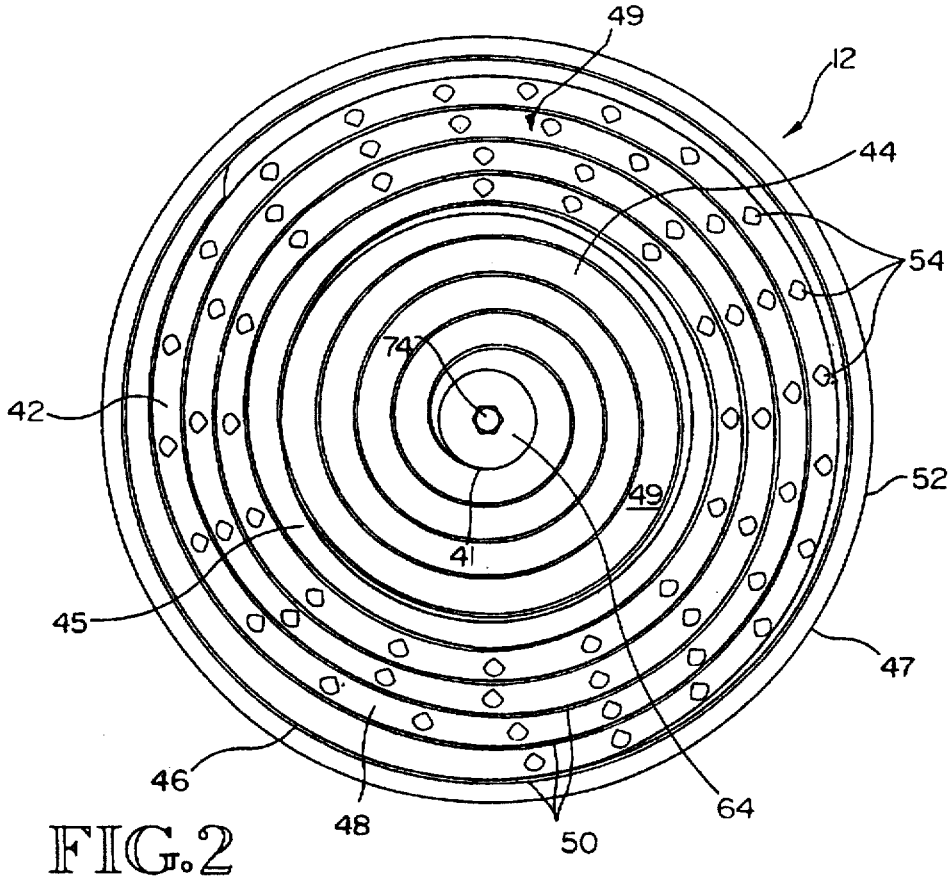
FIG. 2
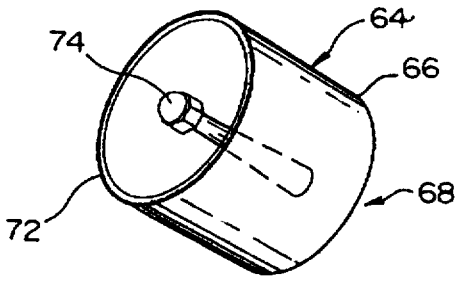
FIG. 5
FIG. 6
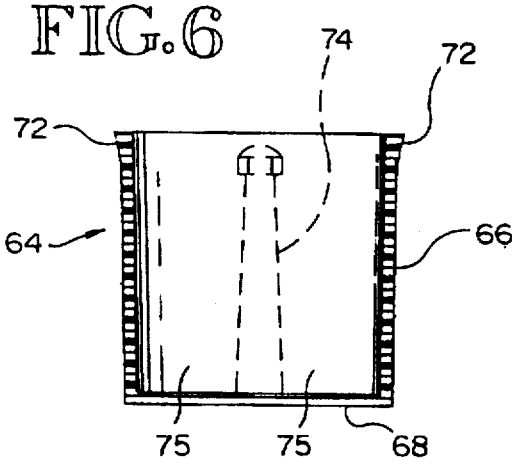

FIG. 8
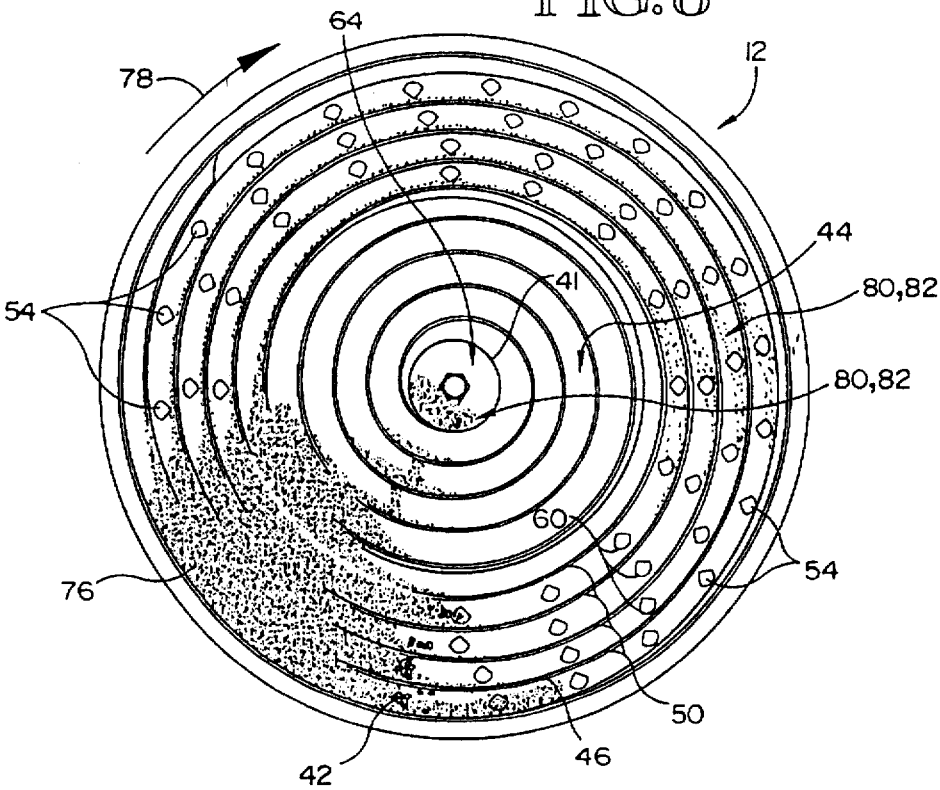
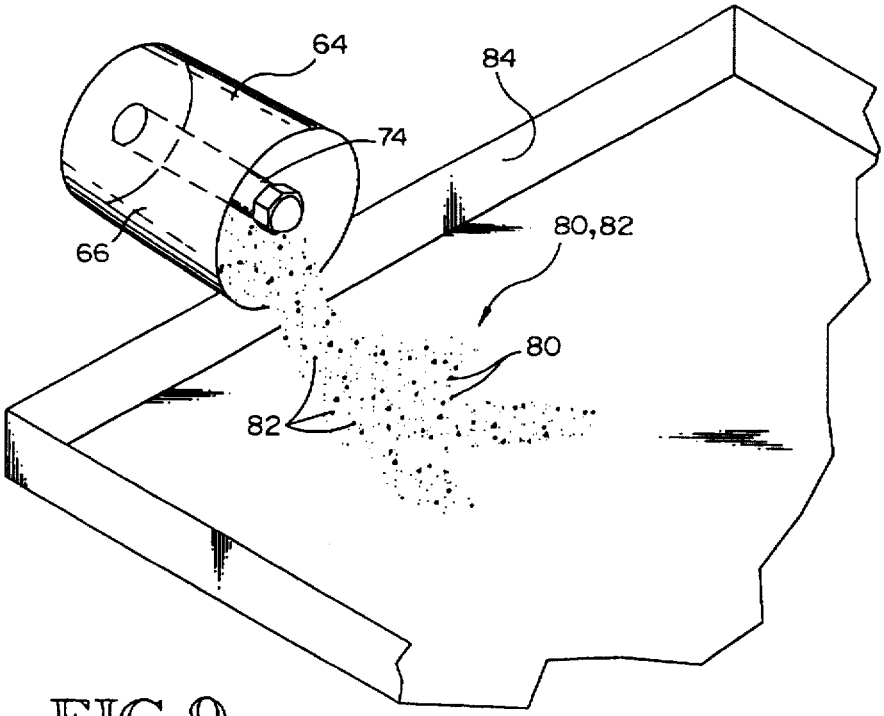
FIG. 9

GOLD PAN WITH AGITATOR KNOBULES AND INSERT CUP

RELATED APPLICATIONS

This application is a continuation-in-part of my U.S. application, Ser. No. 08/709,556, which was filed Sep. 6, 1996, and entitled, "IMPROVED GOLD PAN", now abandoned.

TECHNICAL FIELD

The present invention relates to goldpanning devices and, more particularly, to an improvement in gold particle collection relating to rotating gold pans that include a spiraling surface leading to the center of the pan for separating gold particles from gold ore.

BACKGROUND OF THE INVENTION

My prior U.S. Pat. Nos. 5,273,165 and 5,275,294, both entitled "ROTATING GOLD PAN FOR SEPARATING GOLD PARTICLES FROM ORE," disclose various embodiments for rotating gold pans. The devices include, generally, a three or four legged frame that supports a motor and a rotatable separator pan having a spiraling surface leading to the center of the pan for separating gold particles from gold ore. The present invention is an improvement upon the disclosures of those two patents.

It is an object of the present invention to utilize the advantages gained from the fact that gold is heavier than most other material and debris that it is found with. When the gold ore is introduced into the spiraling separator pan, as disclosed in my aforementioned patents, the heavier gold will naturally sink to the lowest point in the pan on the spiraling surface.

Additionally, it is an object of the present invention to utilize the fact that fine gold particles tend to float and clump together on the surface of water. It is estimated that 80 to 90 percent of all gold can be found in the form of gold dust or flour (micro) gold (generally defined at 200–600 mesh). The recovery of these fine gold particles is where the greatest potential exists for gold panners.

The collection and removal of such fine gold particles has been generally tedious or, worse, unsuccessful. Some gold particles cling to the pan and do not get captured into a central collection area. Some gold particles do collect in the central collection area, but are mixed with other gold ore particles such that further separation is necessary or that a tweezer, toothpick, or suction bottle must be employed to carefully remove each gold particle.

Additionally, most central collection areas are either a pan/cup that catches the gold particles/gold ore particles externally of the separator pan through a hole in the center of the separator pan, or a hub cup, which is a centrally located cup inside and integral of the separator pan, such as disclosed in my aforementioned patents.

The external pan/cup option is undesirable as the external pan/cup may tip over and lose valuable contents, or the wind may blow some gold particles away from the pan/cup during the panning operation. The contents will still need to be further separated to obtain relatively pure gold.

The hub cup option will adequately contain the gold particles, but will also collect non gold particles. Because the hub cup is integral with the separator pan and not removable, tweezers, toothpicks, or suction bottles must be used to access the fine gold particles within the hub cup.

It is a further object of the present invention to more rapidly separate gold particles from gold ore and concentrate the gold particles for ultimate collection. Agitators have been long since known to aid in separation of gold particles from gold ore. An attempt to utilize agitators to separate and concentrate has been disclosed in Tubbs Jr., U.S. Pat. No. 5,447,239, granted Sep. 5, 1995, and entitled, "GOLD PAN WITH FLUKES AND STRATIFIERS". The Tubbs, Jr. disclosure takes a separator pan with a spiraling rib or riffle such as those disclosed in my aforementioned patents and adds elongated flukes to agitate the gold ore during rotation. The apparatus disclosed in Tubb's Jr., however, is ineffective for both agitation and collection. The flukes (agitators) disclosed by Tubbs, Jr. abut the adjacent outer spiraling rib or riffle within the interior surface of the separator pan, thus, interrupting the natural slide track formed between the inwardly facing surface of spiral rib and the pan's inner surface that is inherent in spiraling ribbed separator pans. Because there is no space between the agitator and the adjacent outer spiral rib, the slide track is interrupted each time the gold particles rotate and reach an agitator fluke. This interruption does not serve the goal of quickly transporting the now separated gold particles rapidly into the central collection area. Additionally, Tubbs, Jr. also discloses agitator flukes on the planer bottom portion of the pan adjacent the centrally located collection area. Once any particles do reach the centrally-located collection area, the Tubbs' disclosed agitators on the pan bottom agitate the now collected gold particles when agitation is least desired. Instead of transporting (elevating) any gold particles to the collection area, the disclosed agitators agitate the collected gold particles upward and outward such that they would be likely to be flushed outside the collection area and out of the pan.

DISCLOSURE OF THE INVENTION

The present invention relates to a separator for separating gold particles from gold ore. The separator includes a rotatable separator pan having a bottom wall and, a frusto-conical side wall. The side wall includes a small diameter inner end connected to the bottom wall and a large diameter outer end. The bottom wall and the side wall define an inner surface of the pan beginning at the large outer end and culminating at a recessed hub cup at the center of the bottom wall. The pan further includes a spiral riffle on the inner surface spiraling inwardly from the outer end of the side wall to create loops that spiral to the hub cup first on the side wall of the pan and then on the bottom of the pan. The separator also includes a mounting frame for mounting the pan for rotation about an axis that extends axially through the hub cup at an angle from horizontal.

The spiral riffle comprises a thin wall that extends outwardly from the pan inner surface and is substantially parallel to the axis. A slide track is formed at the lowest portion of the intersection of the riffle wall and the pan inner surface on each loop in relation to the hub cup during rotation. Below the axis, the slide track is formed where the inwardly facing portion of the riffle wall meets the pan inner surface.

One of the main improvements of the present invention is a plurality of agitator knobules located on the side wall of the inner surface of the separator pan. Each knobule has a top and a base that extends forwardly of the separator pan and is positioned between loops of the spiral riffle. A space is defined between the base of each knobule and its adjacent loops.

In use, gold ore containing at least some gold particles is introduced into the pan while the pan is rotating. Gold particles agitated by the knobules to rapidly separate the gold particles from gold ore. The agitator knobules also aid the gold particles into the slide track in order to quickly move the gold particles inwardly along the spiral riffle into the hub cup.

The knobules are preferably positioned between a majority of the loops of the spiral riffle on the side wall of the separator pan but are not positioned between the innermost loop of the spiral riffle on the side wall. This is in order to reduce agitation at a time where the gold particles needs to be settling so as to be able to be readily collected within the hub cup.

The knobules are preferably generally conical in shape. Each knobule has a radially inward exterior surface from the top to the base that extends outwardly generally parallel to the radially outward nearest adjacent loop. The space created between the base of each knobule and its adjacent loops is general equidistant on both sides of the knobule base to its nearest adjacent loop. These features allow the gold particles to easily pass around the knobules and into the slide track during rotation. The top of each knobule is at a height below that of the height of the riffle on the side wall as measured perpendicularly from the side wall.

In preferred form, the spiral riffle extends outwardly on the frusto-conical side wall a distance greater than the spiral riffle extension on that of the planer bottom wall.

It is another key feature of this invention that the separator pan, either with or without the agitator knobules, includes a removable insert cup having a side wall and a planer bottom wall of a size and shape to be frictionally received within the hub cup for the collection of the gold particles. The insert cup is preferably cylindrical in shape and has a centrally positioned handle for easy removal of the insert cup from the hub cup. It is the removable insert cup that contains the gold particles, which makes collection of same easier than pulling out the gold particles with a tweezer, toothpick, or suction bottle. In one embodiment, the insert cup side wall has an upper rim with the side wall flared slightly outward so that its upper rim has a diameter slightly greater than that of the planer bottom wall. In another embodiment, the insert cup is generally cylindrical in shape and the side wall includes an outwardly flared rim such that the side wall engages the inner wall of the hub cup to hold the insert cup within the hub cup.

These and other advantages, objects, and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawing, wherein:

FIG. 2 is a plan view of the separator pan of FIG. 1;

FIG. 5 is a pictorial view of the removable insert cup of FIG. 3, wherein the insert cup includes a flared rim;

FIG. 6 is a sectional view of the removable insert cup taken substantially along lines 6—6 of FIG. 5;

FIG. 8 is a plan view of the separator pan of FIG. 1 shown in a dry panning operation with a supply of gold ore rotating within the pan and moving along the spiral riffle, while being lifted and separated by the agitator knobules such that separated gold particles quickly move into the slide track in order to ascend inwardly on spiral riffle into the insert cup;

FIG. 9 is a pictorial view showing the gold particles and gold ore particles collected in the insert cup of FIGS. 5 and 6 from a dry panning operation dumped into a collection container ready for final separation;

BEST MODE FOR CARRYING OUT THE INVENTION

The present invention is directed to improvements in the collection of gold particles over that of my aforementioned prior U.S. Pat. Nos. 5,273,165 and 5,275,294. Specifically, the present invention is directed to agitator knobules spacially positioned on the inside of the separator pan to rapidly separate gold particles from gold ore and allow the heavier gold particles to sink into the inherent slide track on the separator pan unimpeded by the agitators to maximize recovery of gold particles in a central collection area. Once collection of the gold particles has been accomplished, easy access and removal of such gold particles is desired. To that end, the present invention also provides an easily removable insert cup located at the central collection area to readily remove the collected gold particles.

Figure 1:
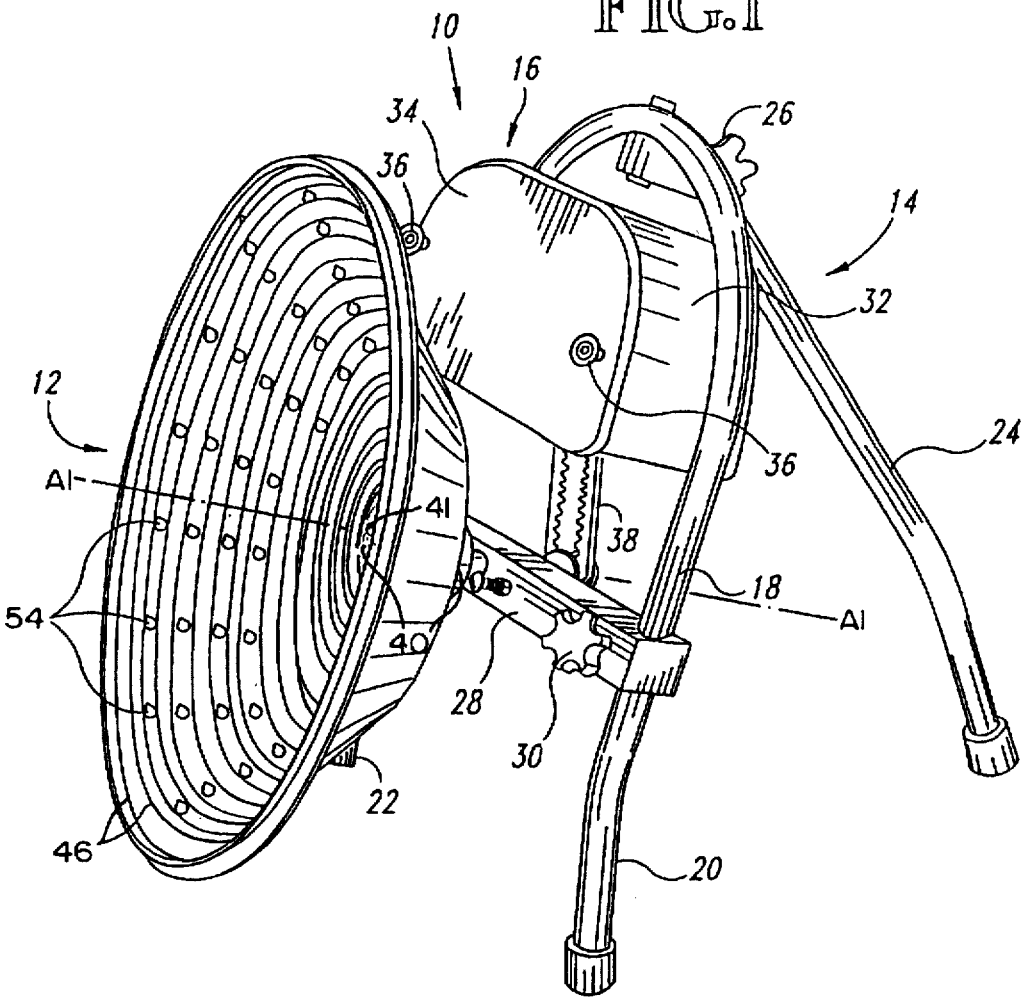
FIG. 1 is a pictorial view of the improved gold pan apparatus of the present invention including a separator pan having a frusto-conical side wall, a planer bottom wall, a centrally located recessed hub cup within the center of the bottom wall, and a spiral riffle spiraling on the inner surface of the pan, first on the side wall, and, then, on the bottom wall and ending at the hub cup, and showing a plurality of agitator knobules spaced between loops of the spiral riffle.

Referring to FIG. 1, the improved gold pan 10 of the present invention is basically characterized by a rotatable separator pan 12, a pan mounting frame 14, and a drive unit 16 for rotating the separator pan 12. Frame 14 and drive unit 16 are described in more detail in my aforementioned U.S. Pat. Nos. 5,275,294, ('294) and 5,273,165, ('165) and are incorporated herein. Generally, frame 14 includes a U-shaped frame piece 18 that has a pair of legs 20–22 and a third rear leg support 24. Rear leg 24 is angularly adjustable relative to the U-shaped frame piece 18 by means of an adjustment mechanism 26 similar in principal to that shown in my aforementioned '294 patent. A cross brace 28 extends between legs 20,22 of U-shaped frame piece 18. A pair of adjustable set screws 30 (only one shown) secure cross brace 28 to U-shaped frame piece 18.

An elongated housing 32 houses some of the drive components of drive unit 16. A lid or cover 34 is removably secured to housing 32 by fasteners 36. A drive belt 38 extends downwardly from drive unit 16 and rotates an axle to which separator pan 12 is mounted. The drive components within housing 32 are discussed in more detail in my aforementioned '294 patent.

Mounting frame 14, in combination with drive components of drive unit 16, rotates separator pan 12 for rotation about an axis A1. Axis A1 extends axially through the center of the separator pan through a hub cup assembly 40 at an angle from a horizontal H better shown in FIG. 3. The hub cup assembly 40 has a recessed inner surface cup 41 (the hub cup) and a corresponding outer surface cup 43 of a size and shape to receive the axle.

Figure 3:
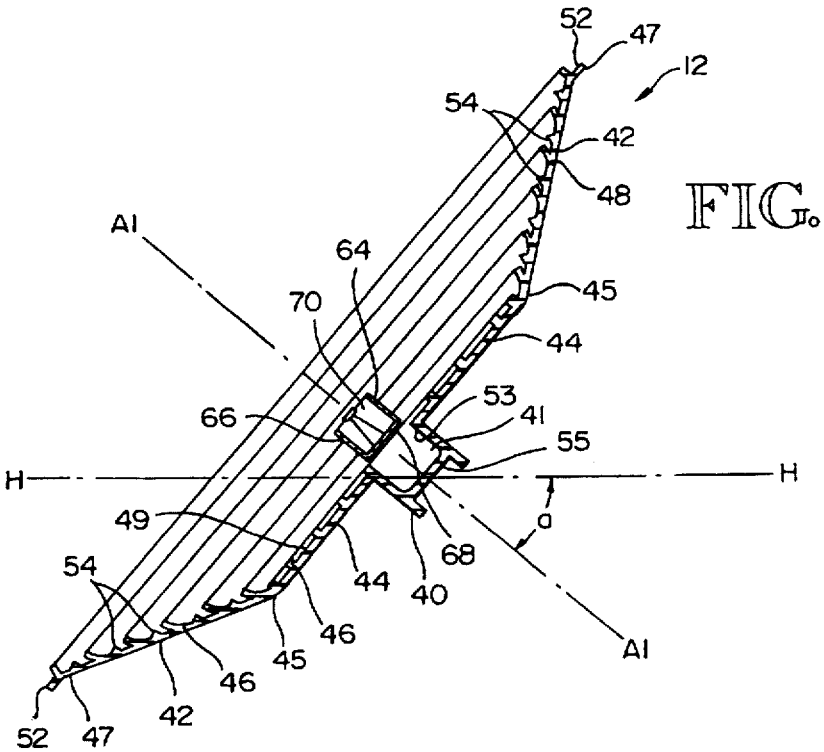
FIG. 3 is an enlarged scale axial sectional view of the separator pan taken substantially along lines 3—3 of FIG. 2 and showing a removable insert cup having a centrally located handle wherein the insert cup is frictionally engagable within the recessed hub cup for easy placement and removal within the hub cup.

Referring also to FIGS. 2 and 3, the separator pan 12 includes a frusto-conical side wall 42 and a planer bottom wall 44. The frusto-conical side wall 42 includes a small diameter inner end 45 connected to the bottom wall and a large diameter outer end 47. The bottom wall 44 and side wall 42 define an inner surface 49 of pan 12 beginning at the large diameter outer end 47 and culminating at a centrally-located recessed hub cup 41, discussed briefly above. Hub cup 41 has an interior surface 51, which is formed at the center of bottom wall 44. Hub cup 41 generally defines a cylindrically-shaped recessed opening 53 with a circular planer 55 bottom in which to receive the collected gold particles during panning.

Inside separator pan 12, a continuous spiral rib, or riffle, 46, loops around pan 12 starting at the pan outer end 47 and creates a spiral path first on the frusto-conical side all 42 and then on the inner surface of bottom wall 44 and culminating at the entrance of hub cup 41. A single spiraling valley 48 bounded by the loops 50 of the spiral riffle 46 is formed as it travels the spiral path. The spiral riffle 46 terminates adjacent the outer edge, or lip 52, of separator pan 12. The spiraling separator pan with the spiral riffle inherently separates the gold particles from the gold ore in the side wall region, elevates the gold particles in the bottom wall region, and concentrates the gold particles in the collection area (the recessed hub cup) during rotation.

Figure 4:
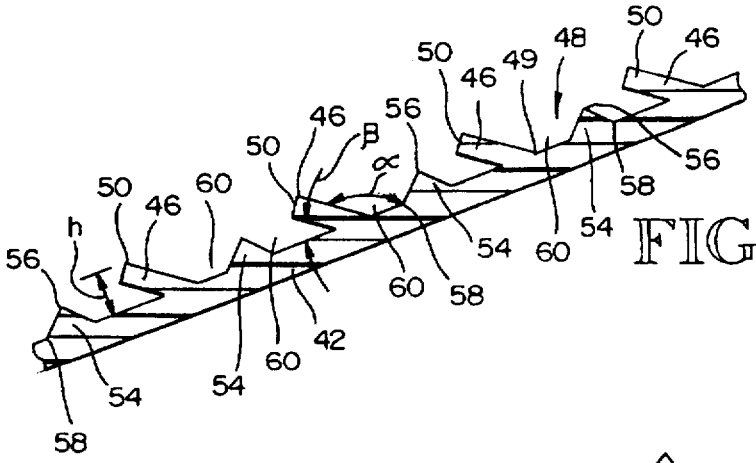
FIG. 4 is an enlarged fragmentary view of a portion of the sectional inner surface of the frusto-conical side wall of FIG. 3 and better showing the slide track formed by and between the inwardly facing wall of the spiral riffle and the pan inner surface in which the gold particles travel along the riffle and the agitator knobules, and their spacial relationship between each adjacent set of loops of the spiral riffle.

As best shown in FIG. 4, spiral riffle 46 is a thin wall that extends substantially parallel to the axis of rotation A, (see FIG. 3). The inner surface of the spiral riffle 46 forms an obtuse angle ($\alpha$), with the inner surface of the frusto-conical side wall 42, which is also referred to as the slide track. The slide track is the inherent lowest point on the pan in which the heavy gold particles naturally gravitates to below the axis A1. The gold particles slide within the slide track during rotation to move the gold particles to the central collection area (hub cup 41). The outer surface of the spiral riffle 46 forms a complementary acute angle ($\beta$) on the inner surface of the side wall 42. The spiral riffle 46, however, forms substantially a right angle where the spiral riffle with the planer bottom wall 44.

The spiral riffle height on side wall 42 as measured perpendicularly to the side wall, is greater than the height of the spiral riffle on the bottom wall 44 because once the gold particles are in this region of the pan the sole goal is to concentrate the gold into the hub cup. There should not be obstacle in elevating the gold to the hub cup at this stage in the panning operation.

Referring still to FIGS. 2–4, one of the main improvements in the separator pan 12 of the present invention, over that of my aforementioned '294 patent, is the provision of a series of agitator knobules 54, which are spaced apart in the spiraling valley 48 and positioned equidistantly between adjacent loops 50 of the spiral riffle 46. Each knobule 54 includes an top, or apex, 56 and a base 58. Each knobule is preferably conical in shape with the apex 56 of each knobule 54 positioned slightly below the height h of the spiral riffle 46 as measured perpendicularly from side wall 42.

Other shapes may be provided, as well, such as semi-spherical or triangular shapes. The position of each conical knobule defines a space 60 between base 58 and adjacent loops of the spiral riffle 46. The radially inward surface of the knobule from the apex 56 to the base 58 is substantially parallel to the radially outward side of its closest inner loop of spiral riffle 46. The spacial position of the knobules provides free access for the heavy gold particles to sink to the lowest point along the riffle (the slide track), which is the obtuse angle a when the contents of the pan are below horizontal line H, yet does not impede the movement of gold particles with the slide track.

In preferred form, there are sixty nine agitator knobules 54 spaced intermittently along the inner surface of the frusto-conical side wall 42 within valley 48. The knobules 54 are preferably not placed on the inner surface of the bottom wall 44 nor on a portion of the inner surface of the frusto-conical side wall 42 because separation at this phase is no longer desired. This is discussed more in the individual panning operation defined by the innermost loop 62 of spiral riffle 46 for reasons discussed below.

Each knobule, in its spacial relationship to the frusto-conical side wall and riffle, improves the inherent separation function of the separator pan by rapidly moving through the old ore. Through this movement, gold particles are more rapidly separated from the gold ore in order to sink to the lowest point on the spiral riffle (the slide track). The quicker the gold particles are positioned into the slide track, the quicker they move inwardly along the spiral riffle into the concentration area (hub cup 41 or insert cup, discussed below). Additionally, the agitators function slightly differently in a wet panning operation from that of a dry operation, both of which are discussed further below.

Figure 7:
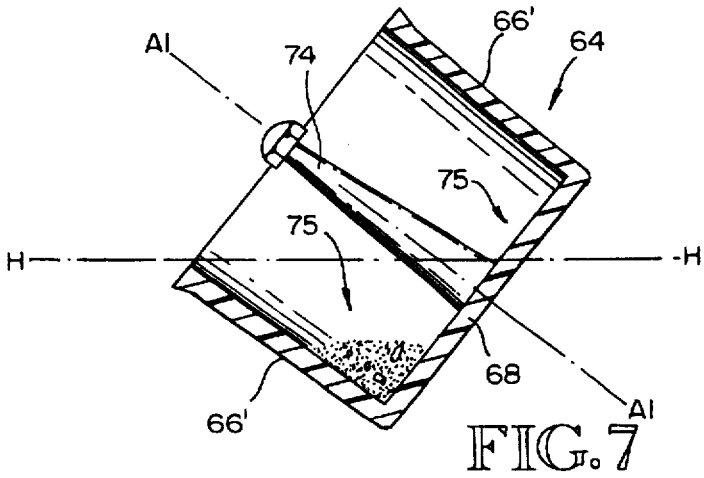
FIG. 7 is a view like FIG. 6 except that the insert cup is shown with flared side walls and inserted into the hub cup at an angle from horizontal and wherein, during a wet panning operation, the insert cup collects virtually "clean" gold particles within the space between the handle, the insert cup side wall, and its planer bottom wall.

Referring to FIGS. 5–7, another main improvement of the separator pan over that of my aforementioned '294 patent is the addition of an easily removable insert cup 64, which is of a size and shape to be frictionally received within recessed hub cup 41. Insert cup 64 is preferably cylindrical in shape and includes a side wall 66, a planer bottom wall 68 and an open top 70. A flared rim 72 (FIGS. 5 and 6) is provided at the open end of the side wall 66 of insert cup 64. Alternatively, insert cup side wall 66 may be a taped sidewall 66', which is tapered inwardly from rim 72 to its planer bottom wall 68 (FIG. 7). Flared rim 72, or alternatively a tapered side wall 66' provides for the frictional engagement of insert cup 64 into the recessed hub cup 41 of separator pan 12. This frictional engagement maintains insert cup 64 within hub cup 41 during panning.

A center post or handle 74 extends upwardly from the planer bottom wall 68 and is located centrally of the insert cup, such that a space 75 is formed between the handle base and the side wall to provide free movement of gold particles and gold ore particles around the handle during panning, such as shown in FIG. 7. The handle 74 is used for easy removal and replacement of insert cup 64 from and into the hub cup 40. Preferably, the handle 74 extends outwardly from planer bottom wall 68 to almost the full height of the side wall 66 and flared rim 72 or slightly past the flared rim 72 for ease in grabbing, especially when the pan is rotating. In this manner, the insert cup provides easy access to the collected gold particles without the need for a suction cup or tweezers. Once the insert cup is full, the insert cup is removed from the hub cup, and the contents are then poured into a vial or other container for safe storage.

The insert cup and knobules 54 are preferably made from a molded man-made material. The separator pan and the agitators are preferably made from polypropylene. The insert cup is made from polyethylene. In manufacturing, the knobules are incorporated into the injection mold such that the separator pan, spiral riffle, and knobules are a one-piece integral plastic structure. The insert cup would be a separate injection molded structure.

In use, the gold pan apparatus of the present invention may be used in either a wet panning or dry panning operation. The frame is positioned within a stream or over a dry bed in an area of the user's choosing. The frame is positioned to rotate the separator pan about the axle at an angle from horizontal. Once the separator pan is rotating, gold ore 76 (the granular material that, amongst other things, contains gold or gold particles) is introduced into side wall of the separator pan at the large diameter outer end.

FIG. 8 shows the separator pan being used in a dry panning operation. The gold ore 76 is placed (shoveled) into separator pan 12 on the inner surface of the frusto-conical side wall as the pan rotates in the direction of arrow 78. As pan 12 rotates, the granular gold ore 76 works through the agitator knobules into granular particles 80 and gold particles 82. In dry panning, the agitator knobules lift the gold ore and separates the gold particles from the gold ore. The gold ore particles may also be the black sand or dirt that comes with the gold particles in the gold ore material. The gold ore is agitated both by the rotating action of the pan 12 and by the movement of the gold ore 76 over the agitator knobules 54. The agitation helps self-classify the gold ore. Thus, as the gold ore 76 is agitated, the low viscosity matter (rocks)is tossed generally about and processed out of the pan while the heavier matter, such as the black sand (collectively gold ore particles 80) and gold particles 82 sink to lowest point in the pan. The gold particles gravitate via the slide track of the spiral riffle 46 inwardly along side wall 42 and then upwardly along bottom wall 44 into the hub cup 41 or the insert cup 64, if the insert cup is received within hub cup 41.

Most gold ore particles and gold particles will move along the slide track (obtuse angle a created by the riffle and frusto-conical side wall),until the pan rotates above the axis A1. Once above the axis the gold particles in the slide track move into the acute angle β of the spiral riffle. As the separator pan 12 rotates, gravity is faster than the rotation speed of the pan and some of the gold particles will fall across the knobules when they reach approximately the two o'clock position. The agitator knobules further assist these gold particles in getting back into the slide track (once again sinking to the lowest point on the riffle) in order to direct these gold particles inwardly along the spiral riffle into insert cup 64.

Once the gold particles have moved from the frusto-conical side wall into the bottom wall, agitation is no longer desired, because the spiral riffle functions to only elevate the gold particles in this region. The spiral riffle on the bottom wall is shorter than that of the height on the side wall in order to start settling the gold particles so that it may collect easily within the insert cup or hub cup. If agitation is done at this point, gold particles that have already been collected to this point may process out of the collection area (hub cup, insert cup,) or, worse, outside the pan. It is also a feature of this invention that no agitators (knobules) are positioned between the innermost loop of the spiral riffle on the side wall in order to begin settling the separated material prior to entering the elevating phase.

In dry panning, some very fine gold particles will cling to pan side wall due to static electricity. Here, the pan rotation must be stopped in order to brush the ultra-fine particles toward the center of the pan.

After a certain amount of gold particles and gold ore particles have collected within insert cup 64, insert cup 64 is removed from hub cup 41 so that the collected particles 80, 82 may be removed for final separation, such as shown in FIG. 9. In the dry panning operation, the gold particles will have to be further separated from the black sand or dirt(gold ore particles) that are collected along with the gold particles, unless a water cleansing procedure is employed to "clean up" the gold, discussed below.

Figure 10:
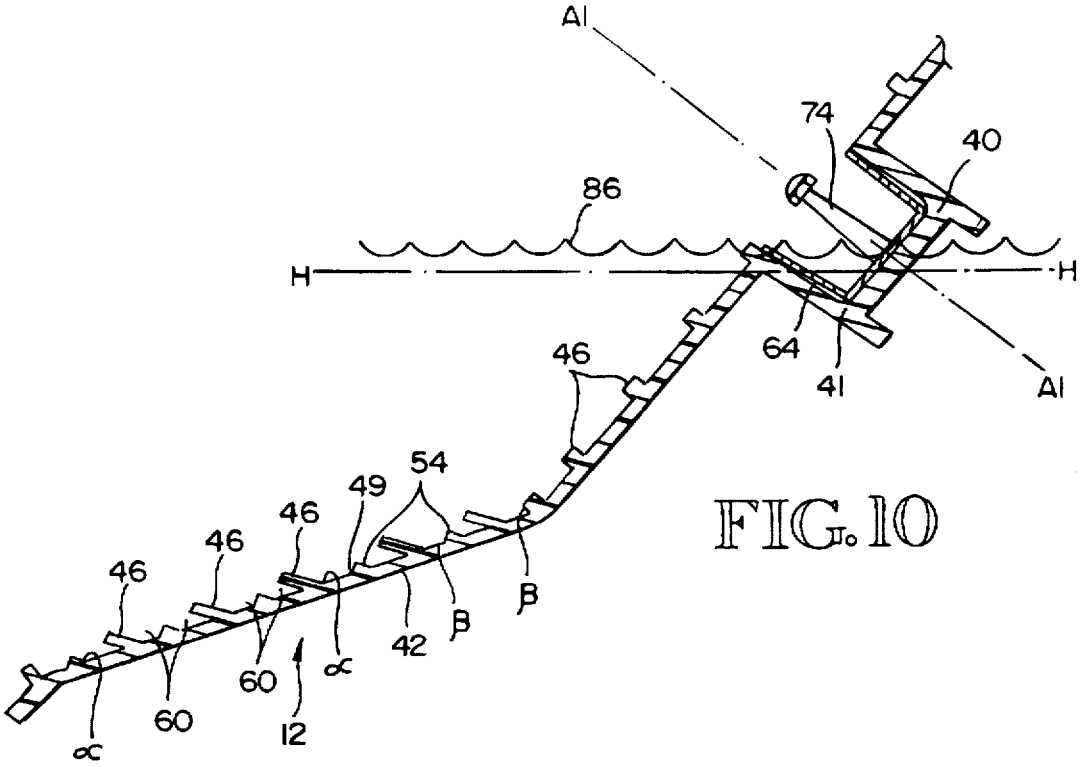
FIG. 10 is an enlarged sectional view of a portion of the separator pan of FIG. 1 during a wet panning operation where the water level is approximately at the level of the lower rim of the hub cup.
Figure 11:
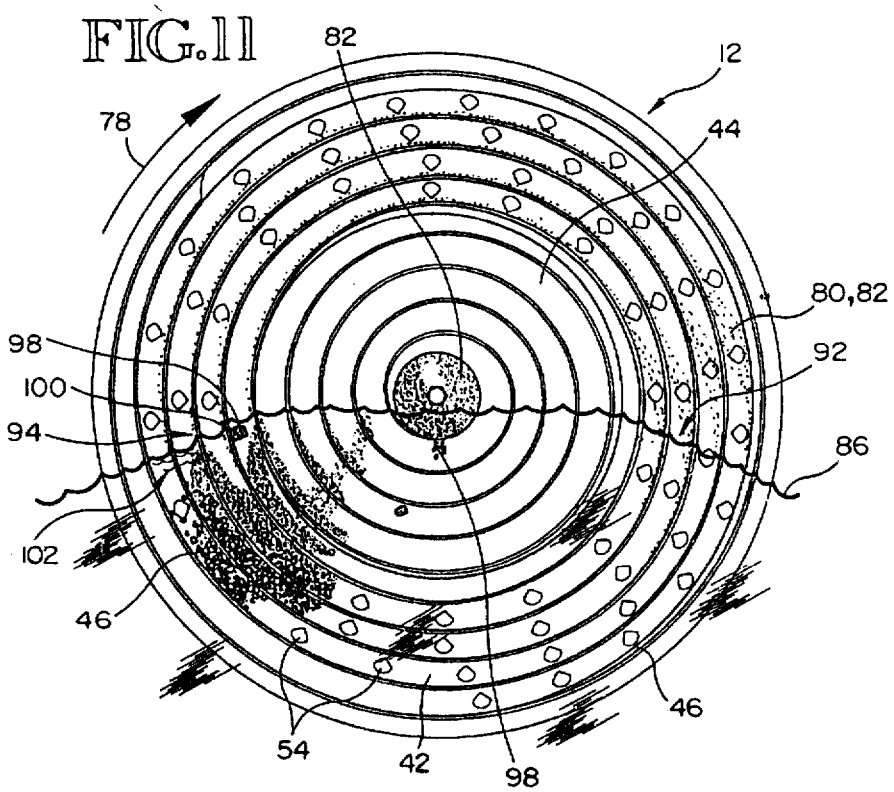
FIG. 11 is a view like FIG. 8, except shown in a wet panning operation, wherein the agitator knobules creates agitation on the water surface in order to collect the fine gold particles suspended on the surface tension of the water by directing such gold particles to clump together in created eddy currents on the water surface.

Referring to FIGS. 10–13, in a wet panning operation, the separator pan 12 is rotated in the direction of arrow 78 similar to a dry panning operation. Here, however, the ideal water line 86 is shown in FIG. 10. Gold particles 82 move along spiral riffle 46 inwardly along side wall 42 and upwardly along bottom wall 44 into hub cup 41, and if used, insert cup 64.

The gold ore is heavier with the addition of the water in the wet panning operation, and, as such, the agitator knobules do not "lift" the gold ore, the way the agitator knobules do in the dry panning process. The spacial relationship of the agitator knobules works with the water to aid the heavier gold particles in sinking to the lowest point along the riffle (a below the axis) and to fill the acute angle β (below the axis) with the remaining gold ore. The low viscosity material is processed out of the pan as the agitator knobules work through the gold ore.

The improvements in the separator pan 12 also serve to make it easier to collect the fine gold particles (the flour gold) During wet panning operations, the fine gold particles tend to cling to the inner surface of side wall 42 and rotate around the separator pan 12 out of the water at a point 92 and back into the water at a point 94. As the fine gold particles 82 contact the water surface 86, at point 94, the fine gold particles tend to displace from the inner surface of the side wall 42 and begin to float on the water surface 96, as shown at 98. Although gold particles are an intrinsically heavy element, the small particles are suspended on the water surface by the water surface tension until a sufficient mass collect to counteract the surface tension. The agitator knobules displace the surface water in a direction from "94" to "92". Thus, fine gold particles 82 are carried toward point 92, where the tend to collect or clump together as shown at 98 in an eddy current 100. The pan may then be stopped in order to remove gold particle clump(s) 98 from the water surface.

Another function that the agitator knobules 54 perform is to provide a certain amount of water agitation to prevent gold particle clumps 98 from escaping outwardly of separator pan 12. Knobules 54 create a small amount of water turbulence adjacent side wall 42 as indicated at 102. As a result, gold particle clumps 98 tend to remain trapped generally at the junction side wall 42 and bottom 44 as shown in FIG. 10. Underneath the water surface 86, knobules 54 also tend to agitate gold ore (material) 76, causing lighter material to be tossed about, while heavier gold particles are moved by spiral riffle 46 upwardly into the collection area, such as the insert cup 64.

Figure 12:
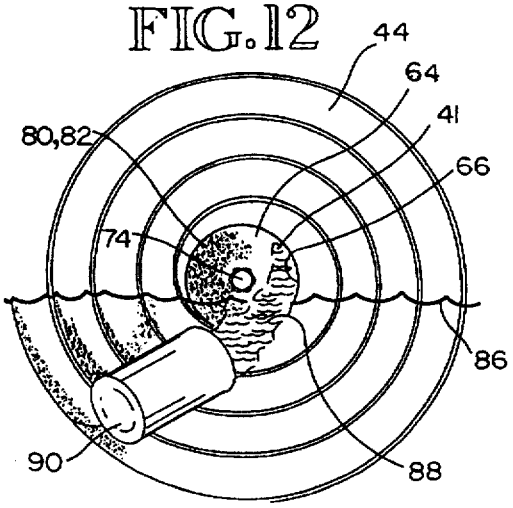
FIG. 12 is an enlarged view of a portion of the bottom wall of the separator pan of FIG. 11 shown with water being splashed into the insert cup, to "clean" the collected gold by removing any remaining non gold particles.
Figure 13:
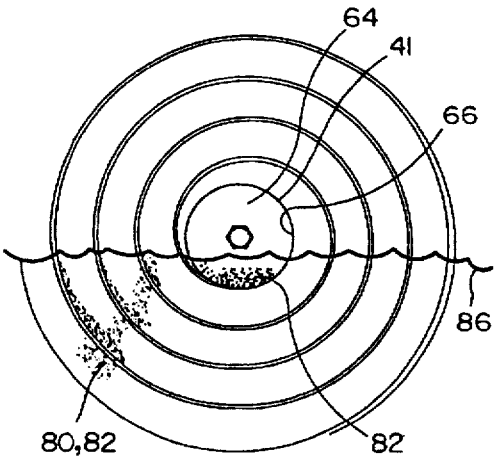
FIG. 13 is a view like FIG. 12 of the insert cup after its been splashed with water and showing a supply of gold particles in the insert cup substantially free of non gold particles.

Once the gold particles have gravitated to center of the pan, "clean" gold particles 82 collect virtually within insert cup 64, or hub cup 41. This is because the washing action of the water removes most of the black sand and dirt away from the gold particles. However, a small amount of non gold particles (80) also collect in the insert cup. As shown in FIG. 12, to remove non-gold particles from the insert cup, water 88 is splashed over the contents of insert cup 64 by means of a cup 90. The water splashed onto the contents of the insert cup functions to wash lighter non-gold particles out of insert cup 64, leaving only clean gold particles behind, as shown in FIG. 13 (as well as FIG. 7). Insert cup 64 can then be removed from hub cup 40 to collect the nearly pure gold particles 82. This final rinsing "cleanup" may also be employed in the dry panning operation, as opposed to further separation as indicated in FIG. 9.

The illustrated embodiments are only examples of the present invention and, therefore, are non-limitive. It to be understood than many changes in the particular structure, materials and features of the invention may be made without departing from the spirit and scope of the invention. Therefore, it is my intention that my patent rights not be limited by the particular embodiments illustrated and described herein, but, rather determined by the following claims, interpreted according to accepted doctrines of claim interpretation, including use of the doctrine of equivalents and reversal of parts.

What is claimed is:

1. A separator for separating gold particles from gold ore comprising:

a rotatable separator pan including a bottom wall, a frusto-conical side wall having a small diameter inner end connected to the bottom wall and a large diameter outer end wherein said bottom wall and said frusto-conical side wall define an inner surface of the pan beginning at the large outer end and culminating at a recessed hub cup at the center of the bottom wall, and wherein said pan further includes a spiral riffle on the inner surface spiraling inwardly from the outer end of the side wall to create loops that spiral to the hub cup, first on the side wall of the pan, and then on the bottom of the pan;

a mounting frame for mounting the pan for rotation about an axis that extends axially through the hub cup at an angle from horizontal;

said spiral riffle comprising a thin wall extending outwardly from the pan inner surface and being substantially parallel to the axis, wherein a slide track is formed at the lowest portion of the intersection of the riffle wall and the pan inner surface on each loop in relation to the hub cup during rotation, and wherein, below the axis, the slide track is formed where the inwardly facing portion of the riffle wall meets the pan inner surface; and said side wall of the separator pan including a plurality of agitator knobules, wherein each knobule has a top and a base that extends forwardly of the inner surface of the separator pan, and is positioned between the loops of the spiral riffle such that a space is defined around the base of each knobule and between the base and its adjacent loops;

wherein, in use, gold ore containing at least some gold particles is introduced into the pan while the pan is rotating, and wherein the gold particles are agitated by the knobules to rapidly separate the gold particles from the gold ore and aid the gold particles into the slide track in order to quickly move the gold particles inwardly along the spiral riffle into the hub cup.

2. The separator of claim 1, wherein the knobules are positioned between the loops of the spiral riffle on the side wall of the separator pan with the exception of the innermost loop of the spiral riffle on the side wall.

3. The separator of claim 1, wherein the knobules are generally conical in shape.

4. The separator of claim 1, wherein each knobule includes an exterior surface on a radially inward side that is generally parallel to the radially outward side of an adjacent loop.

5. The separator of claim 1, wherein the top of each knobule is at a height below that of the height of the riffle on the side wall as measured perpendicularly from the side wall.

6. The separator of claim 1, wherein each agitator knobule is positioned on the inner surface of the separator pan such that the base of each agitator knobule and its adjacent loops further creates two substantially equal sized spaces wherein the first space is bounded by the inwardly facing side of the agitator knobule base and the nearest adjacent inner loop and the second space is bounded by the outwardly facing side of the agitator knobule base and the nearest adjacent outer loop.

7. The separator of claim 1, wherein the riffle extends outwardly on the frusto-conical side wall a distance greater than the spiral riffle extension of the planer bottom wall.

8. The separator of claim 1, and further comprising a removable insert cup having a side wall and a planer bottom wall of a size and shape to be frictionally received within the hub cup for the collection of the gold particles.

9. The separator of claim 8, wherein the insert cup includes a handle for removing the insert cup from the hub cup.

10. The separator of claim 9, wherein the handle is positioned at the center of the insert cup creating a space between the handle and the side wall.

11. The separator of claim 8, wherein the insert cup is generally cylindrical in shape such that the side wall has a upper rim and such side wall flares outwardly so that its upper rim has a diameter slightly greater than the diameter of the planer bottom wall.

12. The separator of claim 8, wherein the insert cup is generally cylindrical in shape and that the side wall includes an outwardly flared rim such that the side wall rim engages a recessed inner wall of the hub cup to hold the insert cup within the hub cup.

13. A separator for separating gold particles from gold ore, comprising:

a rotatable separator pan including a bottom wall, a frusto-conical side wall having a small diameter inner end connected to the bottom wall and a large diameter outer end wherein said bottom wall and said frusto-conical side wall define an inner surface of the pan beginning at the large outer end and culminating at a recessed hub cup at the center of the bottom wall, and wherein said pan further includes a spiral riffle on the inner surface spiraling inwardly from the outer end of the side wall to create loops that spiral to the hub cup, first on the side wall of the pan, and then on the bottom wall of the pan;

a mounting frame for mounting the pan for rotation about an axis that extends axially through the hub cup at an angle from horizontal;

said spiral riffle comprising a thin wall extending outwardly from the pan inner surface and being substantially parallel to the axis, wherein a slide track is formed at the lowest portion of the intersection of the riffle wall and the pan inner surface in relation to the hub cup during rotation, and wherein, below the axis, the slide track is formed where the inwardly facing portion of the wall meets the pan inner surface; and a removable insert cup having a side wall and a bottom wall of a size and shape to be frictionally received within the recessed hub cup, wherein the insert cup is easily removable from the hub cup in order to retrieve collected gold particles;

wherein, in use, gold ore containing at least some gold particles is introduced into the pan while the pan is rotating, and wherein the gold particles separate from the gold ore and sink into the slide track and are moved along the slide track inwardly of the spiral riffle into the insert cup.

14. The separator of claim 13, wherein the insert cup includes a handle for removing the insert cup from the hub cup.

15. The separator of claim 14, wherein the handle is positioned at the center of the insert cup.

16. The separator of claim 13, wherein the insert cup is substantially cylindrical in shape with side wall having an outwardly flared rim, and where the side wall rim engages the hub cup to frictionally hold the insert cup within the recessed portion of the hub cup.

17. The separator of claim 13, wherein the frusto-conical side wall of the separator pan includes a plurality of agitator knobules, wherein each knobule has a top and a base and each knobule extends forwardly of the inner surface of the separator pan and is positioned between the loops of the spiral riffle such that a space is defined around the base of each knobule and between the base of each knobule and its adjacent loops; and wherein, in use, the gold particles are agitated by the knobules to rapidly separate the gold particles from the gold ore and wherein the knobules aid the gold particles into the slide track.

18. A separator for separating gold particles from granular material, comprising:

a rotatable separator pan including a bottom wall, a frusto-conical side wall having a small diameter inner end connected to the bottom wall and a large diameter outer end, a recessed hub cup at the center of the bottom wall, and a spiral rib inside the pan, spiraling inwardly from the outer end of the side wall to the hub cup, first on the side wall of the pan and then on the bottom wall of the pan;

a mounting frame for mounting the pan for rotation about an axis which extends axially through the hub cup and at an angle from horizontal;

wherein the spiral rib includes a radially, inwardly-directed surface which, below the hub cup, slopes forwardly and upwardly, both in the region of the side wall and the region of the bottom; and further comprising a removable insert cup within the hub cup, which insert cup is removable from the hub cup in order to retrieve collected gold particles;

wherein, in use, granular material is introduced into the pan while the pan is rotating and gold particles are held by the spiral rib and moved by the rib inwardly along the spiral path of the rib into the insert cup, and wherein the insert cup is generally cylindrical in shape, including a bottom and a side wall, and the side wall flares outwardly so that its upper rim has a diameter slightly greater than the diameter of the bottom, and the side wall is made of a flexible-resilient material, so that the insert cup is held in the hub cup by contact between the side wall of the insert cup and an inner wall of the recessed portion of the hub cup.

* * * * *